US009010902B1

(12) United States Patent
Kimura

(10) Patent No.: US 9,010,902 B1
(45) Date of Patent: Apr. 21, 2015

(54) PRINT SYSTEM, METHOD FOR CONTROLLING PRINT SYSTEM, AND STORAGE MEDIUM

(71) Applicant: Canon Kabushiki Kaisha, Tokyo (JP)

(72) Inventor: Yusuke Kimura, Kokubunji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/511,040

(22) Filed: Oct. 9, 2014

(30) Foreign Application Priority Data

Oct. 11, 2013 (JP) ..... 2013-213596

(51) Int. Cl.
*B41J 2/01* (2006.01)
*B41J 11/58* (2006.01)

(52) U.S. Cl.
CPC ..... *B41J 11/58* (2013.01)

(58) Field of Classification Search
CPC ..... G03G 15/655; G03G 15/6547; B65H 2511/415; B65H 2513/50; B65H 2301/4217; B65H 2551/27; B41J 13/0036; G06F 3/1259
USPC ..... 347/16, 101, 104, 105, 153, 164
See application file for complete search history.

(56) References Cited

U.S. PATENT DOCUMENTS 7,722,041 B2 * 5/2010 Honda ..... 271/288

FOREIGN PATENT DOCUMENTS

JP 2005-121909 A 5/2005

* cited by examiner

*Primary Examiner* — Thinh Nguyen
(74) *Attorney, Agent, or Firm* — Canon USA, Inc., IP Division

(57) ABSTRACT

A detailed sheet bundle process may be efficiently performed even in a state in which a plurality of general sheet process apparatuses are connected. The print system capable of individually conveying sheets to a plurality of sheet process apparatuses, comprises: an obtaining unit configured to obtain waiting times in which conveyance of a sheet is to be waited between sheet bundles of the sheet process apparatuses and switching times required for switching a sheet discharge destination; a determination unit configured to determine whether a sheet process apparatus to be used is to be changed for every sheet bundle among the sheet process apparatuses in accordance with the waiting times and the switching times obtained by the obtaining unit; and a control unit configured to allow change of a sheet process apparatus to be used for every sheet bundle when the determination unit determines that a sheet process apparatus to be used is to be changed every sheet bundle.

6 Claims, 9 Drawing Sheets

PRINT SYSTEM, METHOD FOR CONTROLLING PRINT SYSTEM, AND STORAGE MEDIUM

BACKGROUND OF THE INVENTION

1. Field of the Invention

The present invention relates to a print system which executes a sheet process using a sheet process apparatus, a method for controlling the print system, and a storage medium.

2. Description of the Related Art

In general, processes of a plurality of finishers are performed in parallel to improve productivity. For example, in Japanese Patent Laid-Open No. 2005-121909, a plurality of sheet process apparatuses having a sheet process function are provided and parallel execution of a plurality of jobs by sharing at least one of the sheet process apparatuses has been proposed.

In recent years, a sheet process system in which a DFD (Document Finishing Device) finisher of a maker different from a maker of an image forming apparatus is connected to the image forming apparatus so that various types of finishing are performed has been strongly demanded.

However, in some sheet process systems including a DFD finisher, a sheet may not be conveyed to the finisher during a finishing process performed by the finisher. In a DFD finisher for a ring binder, for example, a sheet may not be conveyed to the ring binder while rings are attached to a bundle of sheets. Accordingly, in a case where the DFD finisher is connected to the image forming apparatus, an interval between sheets becomes large while a sheet may not be conveyed to the finisher, and accordingly, productivity is degraded.

Here, in a case where a sheet discharge destination is automatically changed for every bundle, if a waiting time between bundles is longer than a processing time for processing a bundle, the DFD finisher may not process a sheet since the DFD finisher is in process, which is a problem.

Furthermore, the DFD finisher and the image forming apparatus are sparsely connected to each other (connection in a state in which the number of acceptable commands shared with each other is small). Therefore, unlike a case where an image forming apparatus and a finisher are made by the same maker, it is difficult for a controller of the image forming apparatus to control a finishing process in detail and perform a parallel process.

As another method, an operator determines whether tandem control is to be performed and generates a job for changing a sheet discharge destination for every bundle in advance before the job is input. However, when this method is employed, a work load is heavy and work efficiency of the operator is deteriorated.

SUMMARY OF THE INVENTION

A print system according to the present invention has a configuration described below.

A print system capable of individually conveying sheets to a plurality of sheet process apparatuses includes an obtaining unit configured to obtain waiting times in which conveyance of a sheet is to be waited between sheet bundles of the sheet process apparatuses and switching times required for switching a sheet discharge destination, a determination unit configured to determine whether a sheet process apparatus to be used is to be changed for every sheet bundle among the sheet process apparatuses in accordance with the waiting times and the switching times obtained by the obtaining unit, and a control unit configured to allow change of a sheet process apparatus to be used for every sheet bundle when the determination unit determines that a sheet process apparatus to be used is to be changed every sheet bundle.

Further features of the present invention will become apparent from the following description of exemplary embodiments with reference to the attached drawings.

DESCRIPTION OF THE EMBODIMENTS

Embodiments of the present invention will be described hereinafter with reference to the accompanying drawings.

System Configuration

First Embodiment

Entire Configuration

Figure 1:
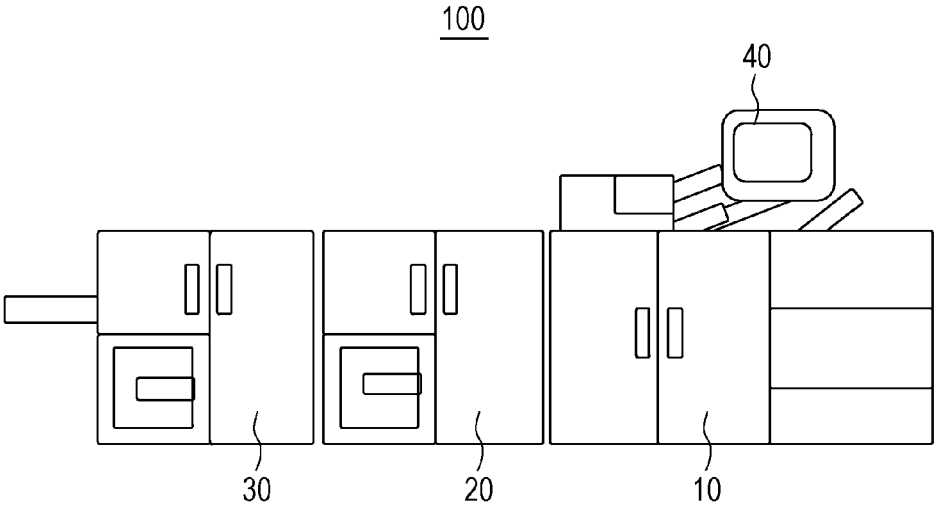
FIG. 1 is a diagram illustrating a sheet process system according to an embodiment.

FIG. 1 is a diagram illustrating a sheet process system (print system) according to a first embodiment. In this embodiment, a print system in which a plurality of sheet process apparatuses are connected to an image forming apparatus and the sheet process apparatuses perform a sheet process in parallel is taken as an example. Furthermore, it is assumed that the individual sheet process apparatuses are general sheet process apparatuses having different control command systems. Note that, a case where tandem connection is employed when the plurality of sheet process apparatuses are connected to the image forming apparatus in parallel will be described.

In FIG. 1, a sheet process system 100 includes DFD (Document Finishing Device) finishers 20 and 30 and an image forming apparatus 10. At least one DFD finisher is connectable in the sheet process system 100. The image forming apparatus 10 has an interface (212) for connection to DFD finishers or the image forming apparatus 10 includes a processing apparatus disposed therein having the interface (212) for connection to DFD finishers.

Entire System Block

Figure 2:
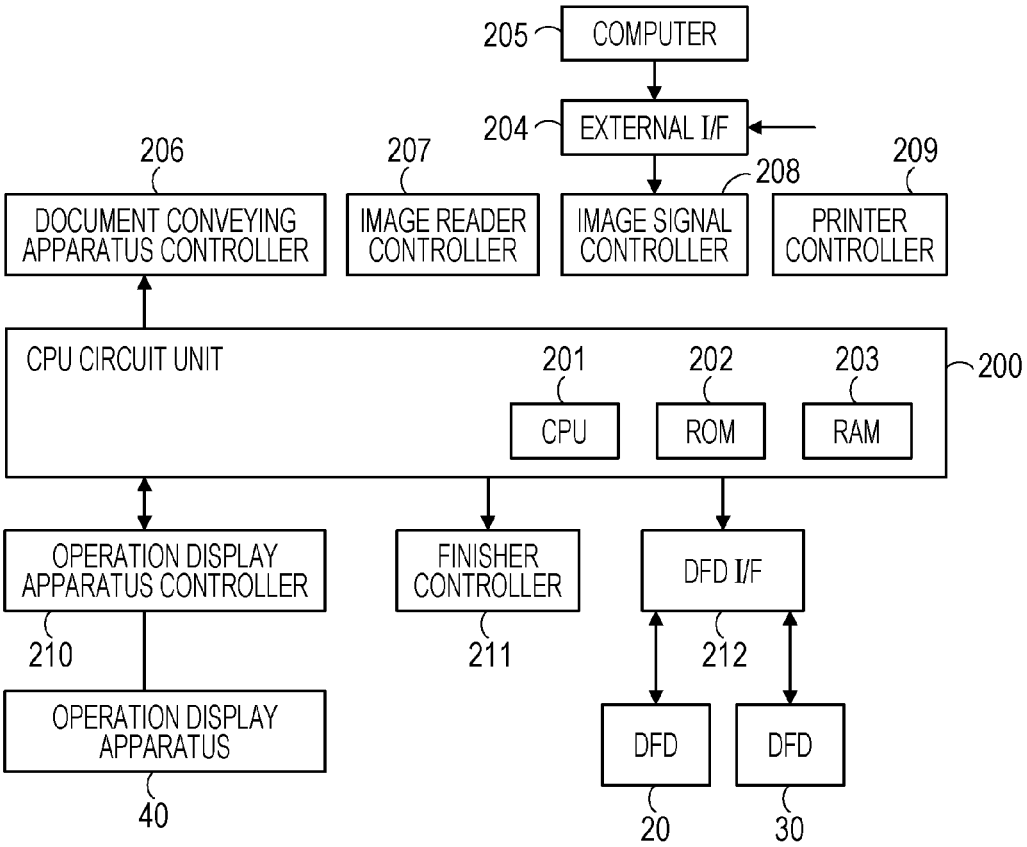
FIG. 2 is a block diagram illustrating a configuration of a controller of the sheet process system.

FIG. 2 is a block diagram illustrating a configuration of a controller which controls the sheet process system 100 illustrated in FIG. 1.

In FIG. 2, the controller includes a CPU circuit unit 200 which incorporates a CPU 201, a ROM 202, and a RAM 203. The CPU 201 performs basic control of the entire sheet process system, and the ROM 202 which includes control programs written therein and the RAM 203 which performs processing are connected to the CPU 201 through an address bus and a data bus.

The CPU 201 integrally controls individual controllers 206, 207, 208, 209, 210, and 211 in accordance with the control programs stored in the ROM 202.

The RAM 203 temporarily stores control data and is used as a work area for calculation processes performed in accordance with the control. The document conveying apparatus controller 206 drives and controls a document conveying apparatus in accordance with an instruction issued by the CPU circuit unit 200.

The image reader controller 207 performs driving control on a scanner unit, an image sensor, and the like and transfers an image signal output from the image sensor to the image signal controller 208. The image signal controller 208 performs various processes after converting an analog image signal supplied from the image sensor into a digital signal, and converts the digital signal into a video signal to be output to the printer controller 209. Furthermore, the image signal controller 208 performs various processes on a digital image signal supplied from a computer 205 through an external I/F 204, and converts the digital image signal into a video signal to be output to the printer controller 209. Note that the image signal controller 208 receives a job for performing a sheet bundle process from the computer 205.

The processing operation performed by the image signal controller 208 is controlled by the CPU circuit unit 200. The printer controller 209 controls an exposure unit and a printer in accordance with the input video signal so that an image formation and sheet conveyance are performed. The finisher controller 211 mounted on a finisher transmits information to and receives information from the CPU circuit unit 200 so as to perform driving control of the entire finisher.

A DFD I/F unit 212 performs transmission and reception of information with a DFD finisher connected thereto. The operation display apparatus controller 210 realizes transmission and reception of information between an operation display apparatus 40 and the CPU circuit unit 200.

The operation display apparatus 40 includes a plurality of keys used to set various functions associated with image formation and a display unit which displays information representing a setting state. The operation display apparatus 40 outputs key signals corresponding to operations on the keys to the CPU circuit unit 200, and displays information corresponding to a signal supplied form the CPU circuit unit 200 in the display unit.

Selection of Productivity Mode

Figure 3:
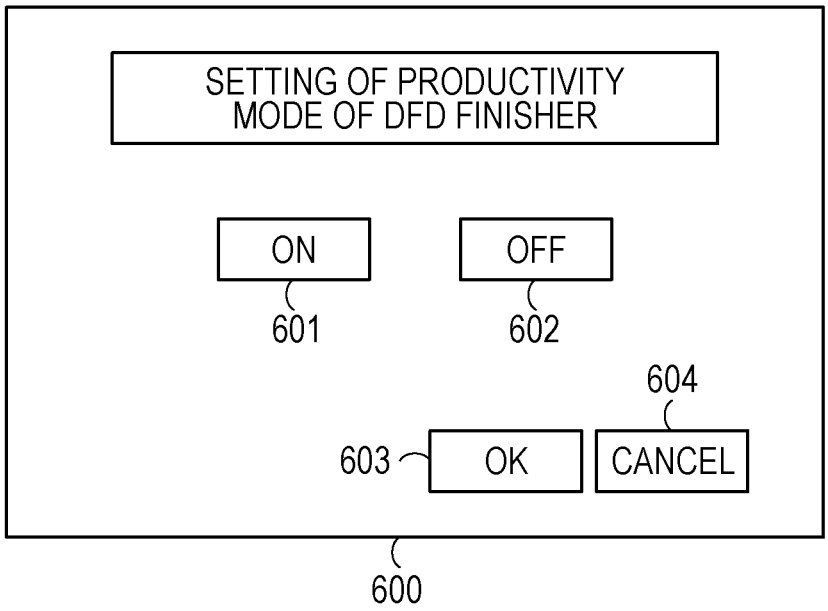
FIG. 3 is a diagram illustrating a UI screen displayed in an operation display apparatus illustrated in FIG. 2.

FIG. 3 is a diagram illustrating a UI screen displayed in the operation display apparatus 40 illustrated in FIG. 2. In a finishing menu selection screen 600 of FIG. 3, a selection screen including an "ON" key 601 and an "OFF" key 602 of the productivity mode is displayed in the display unit. When a user selects the key 601 and presses an "OK" key 603, the productivity mode becomes valid.

When the user selects the key 602 and presses the "OK" key 603, the productivity mode becomes invalid. When the user presses a "Cancel" key 604, a setting is not changed and the setting screen is terminated.

Example of DFD Tandem Control

Figure 4:
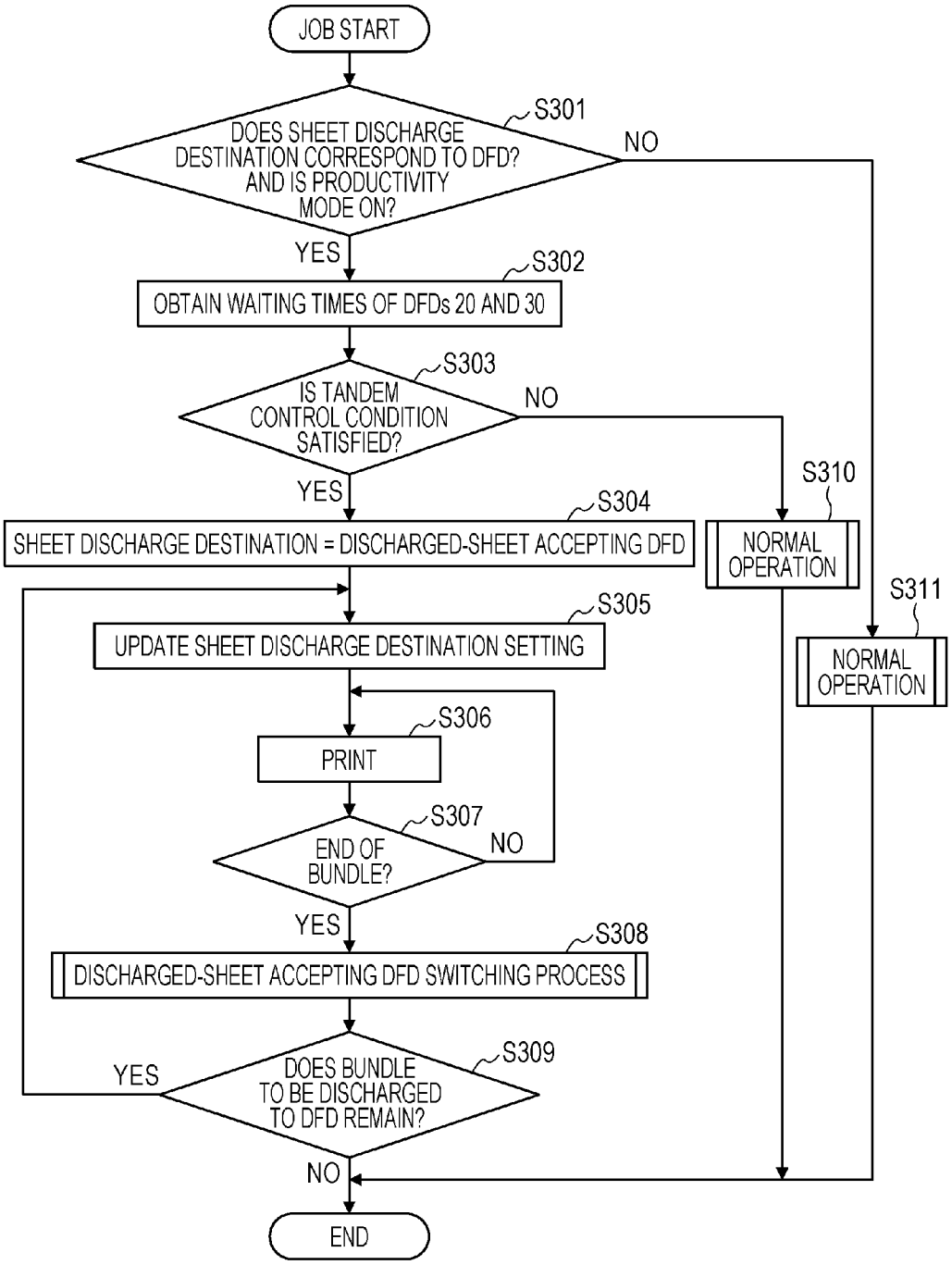
FIG. 4 is a flowchart illustrating a method for controlling a print system of this embodiment.

FIG. 4 is a flowchart illustrating a method for controlling a print system of this embodiment. A job for performing a sheet discharge process is taken as an example. Operations in steps are realized when the CPU 201 executes the control programs stored in the ROM 202. Here, a case where two DFD finishers, that is, the DFD finishers 20 and 30, are connected in a tandem manner as illustrated in FIG. 1 will be described as an example. Furthermore, in this embodiment, when a sheet bundle process is designated in a received job, a determination as to whether the sheet bundle process of alternately performing switching among a plurality of sheet process apparatuses in accordance with waiting times and switching times obtained from the sheet process apparatuses is executable is made, for example.

In step S301, the CPU 201 checks whether a certain condition is satisfied, that is, whether a DFD finisher is designated as a sheet discharge destination of the input job and whether the productivity mode is on. In step S301, when determining that the designation of the sheet discharge destination is a DFD finisher and the productivity mode is on, the CPU 201 proceeds to step S302 so that the printer controller 209 performs tandem control.

On the other hand, when the CPU 201 determines that the certain condition is not satisfied, the CPU 201 proceeds to step S311 so that the printer controller 209 is not allowed to perform tandem control.

In step S302, the CPU 201 obtains waiting times 1 and 2 of the DFD finishers 20 and 30 (hereinafter referred to as DFDs 20 and 30). Here, the waiting time 1 represents a period of time corresponding to an interval of sheet conveyance between bundles to be set for post-processing of a DFD finisher. Here, in this embodiment, different DFD finishers have different waiting times 1. Furthermore, in this embodiment, the waiting time 2 represents a period of time required for changing a sheet discharge destination of a DFD finisher. In step S303, the CPU 201 determines whether tandem control is to be performed in accordance with conditions (1) and (2) below of the DFDs 20 and 30.

Waiting Time 1>Waiting Time 2 Condition (1):

Waiting Time 1>Threshold Value T Condition (2):

Here, a period of time for allowing transition to the tandem control is set as "Threshold Value T". Here, it is assumed that the tandem control is to be performed even when a little waiting time is generated, and the threshold value T is set to 0. When determining that the DFDs 20 and 30 satisfy the two conditions, the CPU 201 proceeds to step S304 so as to cause the printer controller 209 to perform tandem control. When the CPU 201 determines that the DFDs 20 and 30 do not satisfy at least one of the two conditions, the CPU 201 proceeds to step S310 so as not to cause the printer controller 209 to perform tandem control. A normal operation performed in step S310 and step S311 will be described with reference to a flowchart illustrated in FIG. 5 in a later stage.

In step S304, the CPU 201 controls the printer controller 209 to obtain states of the DFDs 20 and 30 and detects a DFD finisher capable of accepting a discharged sheet. When determining that one of the DFDs 20 and 30 corresponding to a sheet discharge destination designated by the job is capable of accepting a discharged sheet, the CPU 201 sets the sheet discharge destination designated by the job as the sheet discharge destination in step S305. When determining that one of the DFDs 20 and 30 corresponding to a sheet discharge destination designated by the job is not capable of accepting a discharged sheet and the other one of the DFDs 20 and 30 is capable of accepting a discharged sheet, the CPU 201 updates the sheet discharge destination capable of accepting a discharged sheet in step S305.

In step S306, the CPU 201 controls the printer controller 209 so that a sheet is supplied from a sheet feeding stage and printing is performed. In step S307, the CPU 201 determines whether a printed page corresponds to an end of a bundle. In step S307, when determining that the printed page does not correspond to an end of a bundle, the CPU 201 controls the printer controller 209 so that printing is performed until the end of a bundle is reached.

On the other hand, in step S307, when determining that the printed page corresponds to an end of a bundle, the CPU 201 notifies the corresponding one of the DFDs 20 and 30 of information representing that the printed page corresponds to an end of a bundle through the DFD I/F unit 212, and the process proceeds to step S308.

In step S308, the CPU 201 calculates waiting times of the DFDs 20 and 30 on the bases of the waiting times 1 and 2, and controls the printer controller 209 so that printing is performed after the sheet discharge destination is switched to one of the DFDs 20 and 30 which corresponds to a smaller interval between bundles. The process will be described in detail with reference to the flowchart illustrated in FIG. 5 in a later stage.

In step S309, the CPU 201 determines whether a bundle to be discharged to the DFD 20 or the DFD 30 remains. When determining that a bundle to be discharged to the DFD 20 or the DFD 30 does not remain, the CPU 201 completes the printing and instructs the printer controller 209 to enter a termination process.

On the other hand, when determining that a bundle to be discharged to the DFD 20 or the DFD 30 still remains, the CPU 201 returns to step S305 and instructs the printer controller 209 to continuously perform the tandem control on a remaining bundle.

Discharged-Sheet Accepting DFD Switching Process

Figure 5:
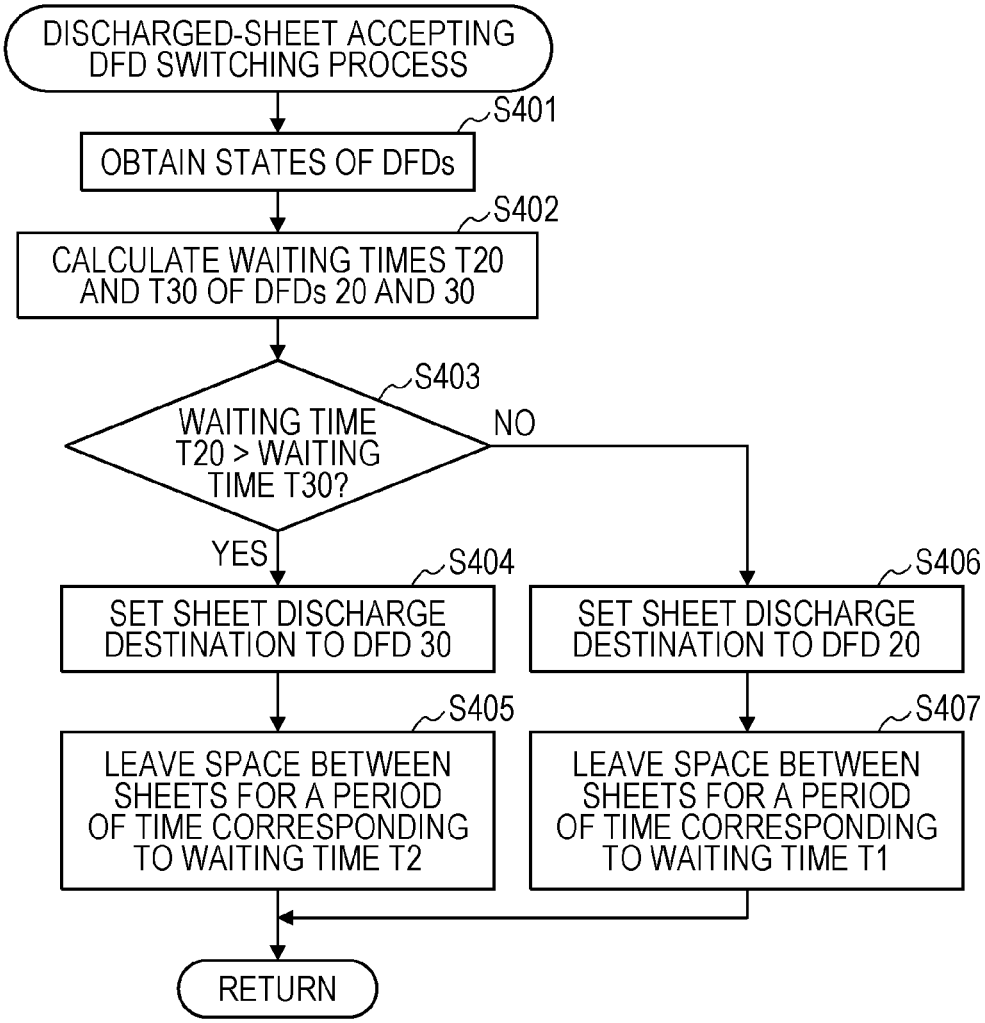
FIG. 5 is a flowchart illustrating the method for controlling a print system.

FIG. 5 is a flowchart illustrating a method for controlling the print system of this embodiment. In this example, in the discharged-sheet accepting DFD switching process in step S308 of FIG. 4, one of the DFDs 20 and 30 which is a destination of sheet discharge is switched to the other of the DFDs 20 and 30 and a waiting time between bundles is controlled. Operations in steps are realized when the CPU 201 executes the control programs stored in the ROM 202. Here, a sheet discharge destination switching pattern illustrated in FIG. 6A will be described as an example of processing on a bundle. Specifically, in FIG. 6A, a state in which the DFD 30 is currently in an idling state and the DFD 20 is executing a sheet process is illustrated. More specifically, an unrequired waiting time for switching between the DFDs 20 and 30 is avoided in a case where one of the DFDs 20 and 30 is executing a sheet process and the other of the DFDs 20 and 30 is in the idling state. That is, control is performed such that a waiting time T1 is set to one of the DFDs 20 and 30 which performs the sheet process in first after the sheet process, and the other of the DFDs 20 and 30 which is in an idling state performs the sheet process on a next sheet bundle when a waiting time T2 is elapsed after the sheet discharge destination switching and before the sheet process. By this, the control is performed so that an unrequired process waiting time is not generated when switching is performed, and consequently, switching between the DFDs 20 and 30 is efficiently performed.

Furthermore, in a description below, meanings of mathematical expressions associated with a bundle 2 are assumed as follows in the switching pattern illustrated in FIG. 6A. For example, if "T2>T1×C" is satisfied, a waiting time T20(C) required by the DFD 20 is equal to T2, and otherwise, the waiting time T20(C) is equal to T1. Here, "C" represents a state of a DFD, and in a case of an idling state, C is 0 and in a case of a post-processing state, C is 1. The same is true on the waiting time T30(C) required by the DFD 30.

Accordingly, a waiting time T20(C) obtained when "C=1" (the state in which the post-processing is being performed) is satisfied is represented by "T20(C)=T1" from "T2>T1×C=T1×1". On the other hand, the waiting time T20(C) obtained when "C=0" (the idling state) is satisfied is represented by "T20(C)=T2" from "T2>T1×C=T1×0". Here, assuming that "C" represents a state, "C=1" represents a state in which the sheet process is being performed and "C=0" represents an idling state, that is, the sheet process is not being performed. Hereinafter, waiting times between sheet bundles of the sheet process apparatuses and switching times for switching a destination of discharge of a sheet bundle are obtained. Next, control performed when it is determined that a sheet bundle process of alternately switching a plurality of sheet process apparatuses with reference to the obtained waiting times and the obtained switching times is executable will be described. Specifically, an example in which the CPU 201 performs control for performing switching between a first sheet bundle process in which sheet bundle processes performed by the sheet process apparatuses are alternately switched and a second sheet bundle process in which the sheet bundle processes performed by the sheet process apparatuses are not alternately switched will be described.

In step S401, the CPU 201 obtains states C of the DFDs 20 and 30 connected thereto. When an end of a bundle 1 illustrated in FIG. 6A is taken as an example, the DFD 20 is in a state in which a post-processing is being performed on the bundle 1 (C=1) and the DFD 30 is in an idling state (C=0). In this case, the CPU 201 sets 1 to C of the DFD 20 and 0 to C of the DFD 30 as the states of the DFDs 20 and 30.

In step S402, the CPU 201 calculates waiting times T20 and T30 of the DFDs 20 and 30, respectively, from the waiting time 1 (T1) required for post-processing and the waiting time 2 (T2) required for switching a sheet bundle discharge destination. Assuming that T1 is larger than T2, in a case of the bundle 2 illustrated in FIG. 6A, when "T20(C)=(T2>T1×C)" is satisfied and an expression of "T2:T1" is calculated in accordance with the example above, "T20=T(20C)=T1" is obtained since "T2>T1×C (C=1)" is satisfied.

On the other hand, since "T30=T(30C)=(T2>0)" is satisfied, "T30=T2" is obtained. In step S403, the CPU 201 compares the waiting times of the DFDs 20 and 30 with each other until a next bundle is processed.

In step S403, when determining that the waiting time T20 of the DFD 20 is larger than the waiting time T30 of the DFD 30, the CPU 201 sets the DFD 30 as a sheet discharge destination (S404). Furthermore, the CPU 201 instructs the printer controller 209 to execute a sheet bundle process such that an interval between sheets corresponding to the waiting time T30, that is, T2 calculated by the foregoing process in this case (refer to FIG. 6A), is maintained (S405) and this process is terminated.

On the other hand, in step S403, when determining that the waiting time T30 of the DFD 30 is equal to or larger than the waiting time T20 of the DFD 20, the CPU 201 sets the DFD 20 as a sheet discharge destination (S406). Furthermore, the CPU 201 instructs the printer controller 209 to execute a sheet bundle process such that an interval between sheets corresponding to the waiting time T20, that is, T1 in this case (refer to FIG. 6A), is maintained (S407) and this process is terminated.

In the case of the foregoing example, the waiting time T20 is larger than the waiting time T30 before processing is performed on the bundle 2, and therefore, the CPU 201 instructs the printer controller 209 to set the DFD 30 as a sheet discharge destination in step S404 and maintain the waiting time of T30, that is, an interval between sheets corresponding to T2, in step S405.

Next, a case of an end of the bundle 2 will be described. The CPU 201 obtains states C of the DFDs 20 and 30. When determining that the DFD 20 is in an idling state (C=0) and the DFD 30 is in a state in which post-processing is being performed on the bundle 2 (C=1), the CPU 201 sets the state of the DFD 20 as "C=0" and the state of the DFD 30 as "C=1". In step S402, the CPU 201 calculates the waiting times T20 and T30 of the DFDs 20 and 30, respectively, from the waiting time T1 (T1) and the waiting time 2 (T2).

Figure 6A:
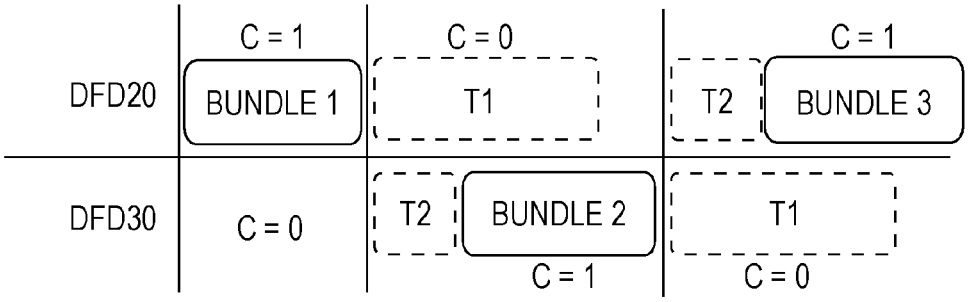
FIGS. 6A and 6B are diagrams illustrating sequences of bundle processes performed by a plurality of DFDs.

Assuming that T1 is larger than T2, in a case of a bundle 3 illustrated in FIG. 6A, T2 is larger than 0, and accordingly, "T20=T(20C)=T2" is satisfied. On the other hand, since "T30=T(30C)=(T1×b>T2)" is satisfied, "T30=T1" is obtained. Since the waiting time T30 is larger than the waiting time T20 before the bundle 3 is processed, the CPU 201 sets the DFD 20 as a sheet discharge destination in step S406. Thereafter, the CPU 201 instructs the printer controller 209 to execute a sheet bundle process such that an interval between sheets corresponding to the waiting time T20, that is, T2 (refer to FIG. 6A), is ensured in step S407.

Hereinafter, a pattern illustrated in FIG. 6B will be described as an example of processing on bundles. In this pattern, a case where the waiting time T1 is larger than a bundle processing time Tp (an elapsed time from when the bundle 1 is terminated to when the end of the bundle 2 is reached) will be described. A sheet bundle switching process which is the same as that illustrated in FIG. 6A is performed on the end of the bundle 1, and therefore, detailed description thereof is omitted.

Figure 6B:
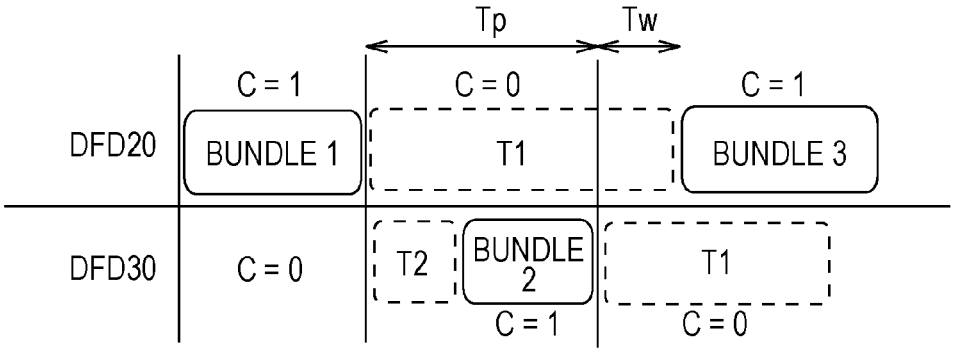

In a case of the end of the bundle 2 illustrated in FIG. 6B, when the CPU 201 obtains states of the DFDs 20 and 30, the DFDs 20 and 30 are both in a state in which a post-processing is being performed on a bundle (C=1). In this case, the CPU 201 sets 1 to C of the DFD 20 and 0 to C of the DFD 30 as the states of the DFDs 20 and 30. Here, the CPU 201 calculates a processing time Tp from when the bundle 1 is terminated to when the end of the bundle 2 is reached, and calculates a remaining waiting time Tw of the DFD 20 at a time when the end of the bundle 2 is reached.

The CPU 201 calculates "Tw=T1−Tp" and when Tw is larger than 0, the CPU 201 determines that the waiting time still remains and compares Tw with T2. When Tw is equal to or smaller than 0, the CPU 201 determines that the waiting time does not remain and calculates T20 using T2 of the waiting time 2. When Tw is larger than 0 or when Tw is larger than T2, a next bundle is not processed unless an interval between sheets corresponding to the waiting time Tw is ensured, and accordingly, when the calculation expression in step S402 is "T(20C)=(T2>Tw)", calculation is performed as "T2:Tw".

In this case, since Tw is larger than T2, the CPU 201 performs calculation provided that T20 is equal to Tw and T30 is equal to T1. Since the waiting time T30 is larger than the waiting time T20 before the bundle 2 is processed, the CPU 201 instructs the printer controller 209 to perform a sheet bundle process such that the DFD 20 is set as a sheet discharge destination in step S406 and the waiting time T30, that is, an interval between sheets corresponding to Tw, is ensured in step S407.

Normal Operation

Figure 7:
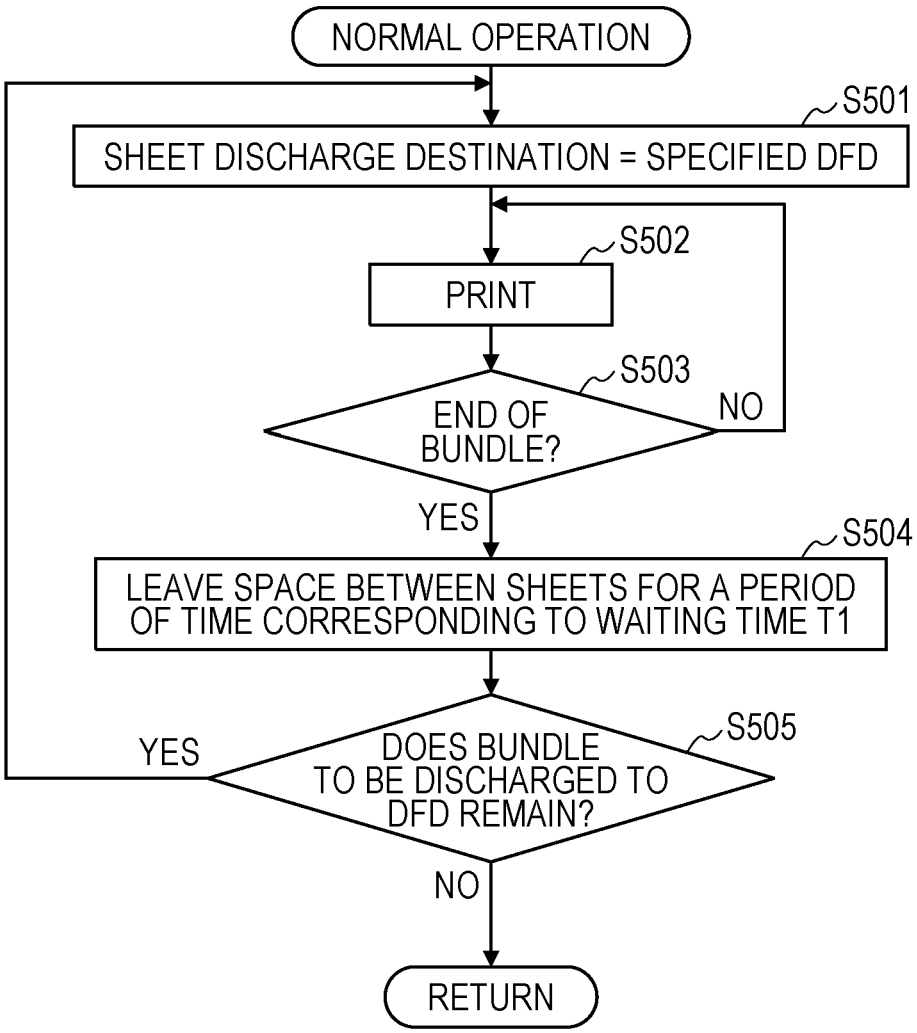
FIG. 7 is a flowchart illustrating the method for controlling the print system.

FIG. 7 is a flowchart illustrating the method for controlling the print system of this embodiment. In this example, a waiting time is controlled on the basis of the waiting time 1 between bundles without changing a sheet discharge destination DFD. This process is realized when the CPU 201 executes the control programs stored in the ROM 202.

In step S501, the CPU 201 instructs the printer controller 209 to set a DFD finisher designated by an input job as a sheet discharge destination. In step S502, the CPU 201 instructs the printer controller 209 to feed a sheet from the sheet feeding stage and perform printing. In step S503, the CPU 201 determines whether a printed page corresponds to an end of a bundle. In step S503, when determining that the printed page does not correspond to an end of a bundle, the CPU 201 instructs the printer controller 209 to perform printing until an end of a bundle is reached.

On the other hand, in step S503, when determining that the printed page corresponds to an end of a bundle, the CPU 201 notifies the DFD finisher of information representing that the printed page corresponds to an end of a bundle through the DFD I/F unit 212, and the process proceeds to step S504. In step S504, the CPU 201 instructs the printer controller 209 to execute sheet bundle processing so that an interval between sheets corresponding to the waiting time 1, that is, T1, is ensured.

In step S505, the CPU 201 determines whether a bundle to be discharged to the DFD finisher remains. When determining that a bundle to be discharged to the DFD finisher does not remain, the CPU 201 completes the printing and instructs the printer controller 209 to perform a termination process.

On the other hand, when determining that a bundle to be discharged to the DFD finisher still remains, the CPU 201 returns to step S501 and instructs the printer controller 209 to continue the tandem control on a remaining bundle.

By the procedure described above, a job input side may automatically perform tandem control without taking sheet discharge destination switching performed for tandem control of DFD finishers into consideration, while a waiting time between sheet bundles is controlled on a print system side.

Second Embodiment

DFD Tandem Control

When sheets are considered as a bundle, the bundle is a unit of a job. In a case where output order of jobs is determined, if the tandem control is automatically performed, the output order (overlapping method) of bundles desired by the user may not be satisfied.

A case where processing is performed in a later stage after sheets are set to an offline finisher in output order may be taken as an example. In this case, the CPU 201 is required to instruct the printer controller 209 not to perform the tandem control depending on use of a bundle.

However, when a job in which the number of copies is specified is input, the tandem control may be performed since an original is copied and therefore the output order is not important. An operation to be performed when the CPU 201 controls the printer controller 209 after determining whether the output order of a bundle of the input job is to be guaranteed under this situation will be described with reference to FIGS. 8 and 9.

Figure 8:
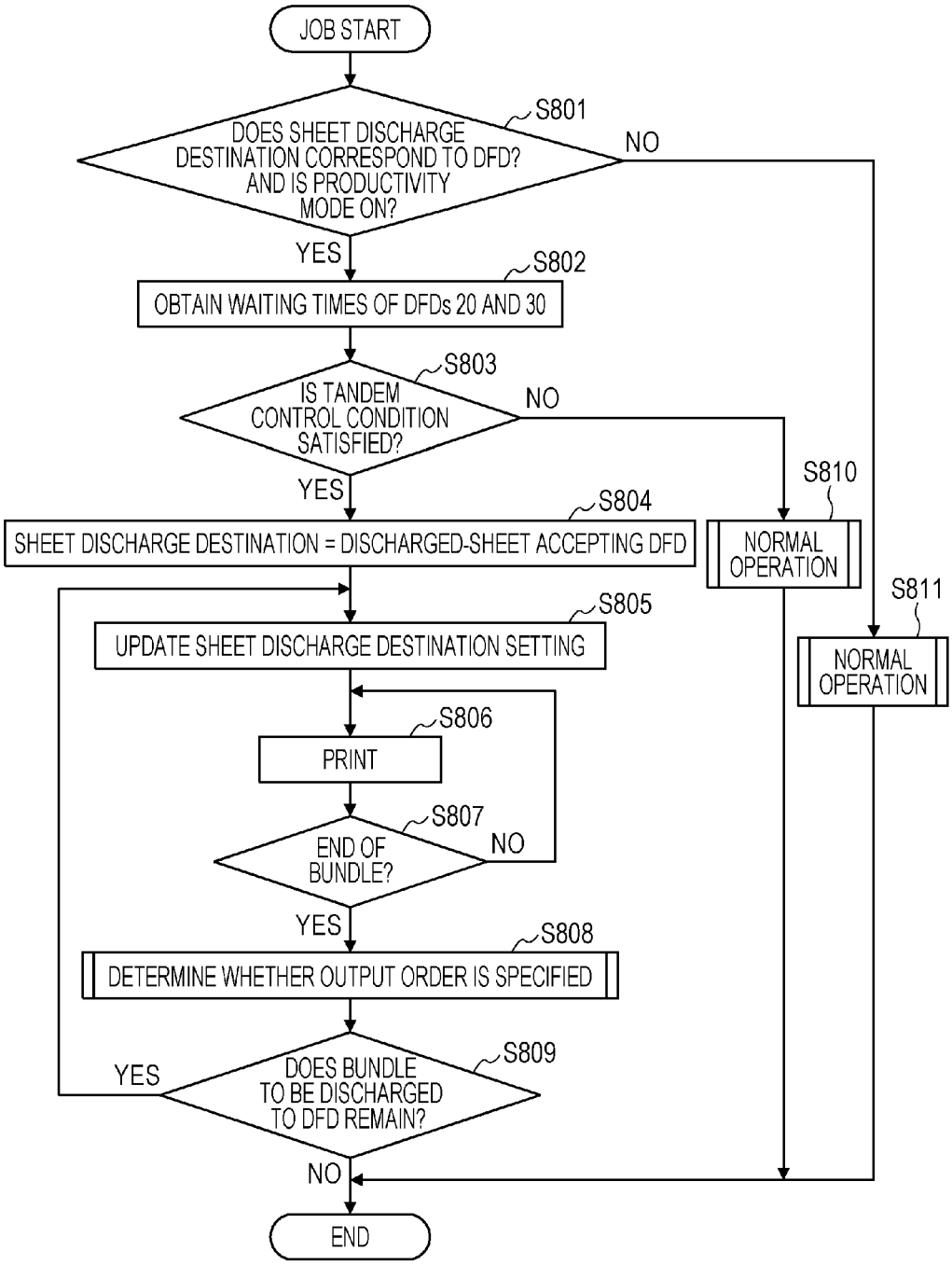
FIG. 8 is a flowchart illustrating the method for controlling the print system.

FIG. 8 is a flowchart illustrating a method for controlling the print system of this embodiment. A job for performing a sheet discharge process is taken as an example. This process is realized when the CPU 201 executes the control programs stored in the ROM 202.

Note that, a basic sequence of this process is the same as that illustrated in FIG. 4, and therefore, only different portions will be described. A process from step S801 to step S807 is the same as that in FIG. 4, and a description thereof is omitted.

In step S808, the CPU 201 determines whether output order is designated, and instructs the printer controller 209 to perform tandem control only on jobs in which the output order is not designated.

Figure 9:
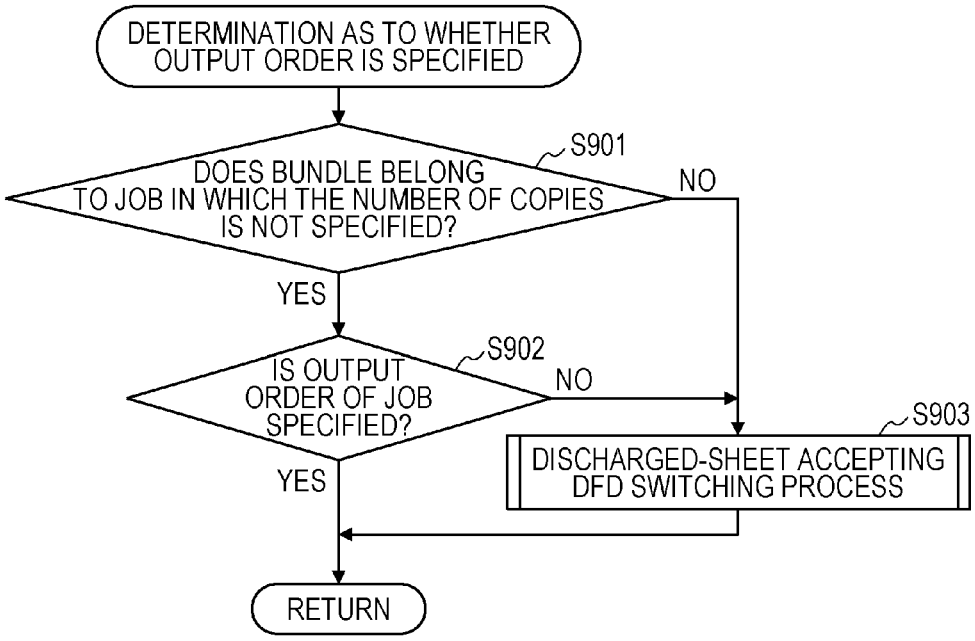
FIG. 9 is a flowchart illustrating the method for controlling the print system.

FIG. 9 is a flowchart illustrating the method for controlling the print system of this embodiment. Here, an example of the output order determination process will be described. This process is realized when the CPU 201 executes the control programs stored in the ROM 202.

In step S901, the CPU 201 determines whether a bundle is a copy of a first bundle as a job to which the bundle belongs. As a method for the determination, a method for making the determination by making a determination by the CPU 201 as to whether the number of copies of 2 or more has been set in the job to which the bundle belongs may be employed. In step S901, when determining that the bundle belongs to the job in which the number of copies is specified, the CPU 201 proceeds to step S902.

On the other hand, in step S901, when determining that a plurality of copies are specified in the job setting, the CPU 201 proceeds to step S903 and instructs the printer controller 209 to perform tandem control in accordance with a sheet discharge destination DFD switching process illustrated in FIG. 7. When a plurality of copies are specified, content of a bundle is the same, and therefore, different sheet discharge destinations are allowed to be assigned to the copies.

In step S902, the CPU 201 determines whether the output order has been specified to the job. As a determination method, the determination may be made using a parameter added for specifying the output order to an attribute of the job or may be made using a switch of an output order specifying mode.

When determining that the job output order has been specified, the CPU 201 does not perform the tandem control, and instructs the printer controller 209 to proceed to a next process.

On the other hand, when determining that the job output order has not been specified, the CPU 201 proceeds to step S903 so as to instruct the printer controller 209 to perform the tandem control in accordance with the discharged-sheet accepting DFD switching process illustrated in FIG. 5. The content of the process in step S808 has been described hereinabove. The process after step S809 is the same as that illustrated in FIG. 4, and therefore, a description thereof is omitted.

According to the procedure described above, performance of the tandem control may be controlled depending on designation of the number of copies and designation of the output order.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-213596, filed Oct. 11, 2013, which is hereby incorporated by reference herein in its entirety.

What is claimed is:

1. A print system capable of individually conveying sheets to a plurality of sheet process apparatuses, the print system comprising:

an obtaining unit configured to obtain waiting times in which conveyance of a sheet is to be waited between sheet bundles of the sheet process apparatuses and switching times required for switching a sheet discharge destination;

a determination unit configured to determine whether a sheet process apparatus to be used is to be changed for every sheet bundle among the sheet process apparatuses in accordance with the waiting times and the switching times obtained by the obtaining unit; and a control unit configured to allow change of a sheet process apparatus to be used for every sheet bundle when the determination unit determines that a sheet process apparatus to be used is to be changed every sheet bundle.

2. The print system according to claim 1, wherein the control unit performs control so that a sheet process apparatus to be used is not changed for every sheet bundle when the determination unit does not determine that a sheet process apparatus to be used is to be changed for every sheet bundle.

3. The print system according to claim 1, further comprising:

a reception unit configured to receive a job for performing a sheet process, wherein the determination unit determines whether a sheet process apparatus to be used is to be changed for every sheet bundle among the sheet process apparatuses in accordance with the waiting times and the switching times obtained by the obtaining unit when a sheet process is specified by the job received by the reception unit.

4. The print system according to claim 1, further comprising:

a print unit configured to print an image on a sheet.

5. A method for controlling a print system capable of conveying sheets to a plurality of sheet process apparatuses, the method comprising:

obtaining waiting times in which conveyance of a sheet is to be waited between sheet bundles of the sheet process apparatuses and switching times required for switching a sheet discharge destination;

determining whether a sheet process apparatus to be used is to be changed for every sheet bundle among the sheet process apparatuses in accordance with the obtained waiting times and the obtained switching times; and changing a sheet process apparatus to be used for every sheet bundle when it is determined that a sheet process apparatus to be used is to be changed every sheet bundle.

6. A program that causes a computer to execute a method for controlling a print system capable of conveying sheets to a plurality of sheet process apparatuses, the method comprising:

obtaining waiting times in which conveyance of a sheet is to be waited between sheet bundles of the sheet process apparatuses and switching times required for switching a sheet discharge destination;

determining whether a sheet process apparatus to be used is to be changed for every sheet bundle among the sheet process apparatuses in accordance with the obtained waiting times and the obtained switching times; and changing a sheet process apparatus to be used for every sheet bundle when it is determined that a sheet process apparatus to be used is to be changed every sheet bundle.

* * * * *